US005725149A

United States Patent [19]

Goossens

[11] Patent Number: 5,725,149

[45] Date of Patent: Mar. 10, 1998

[54] SUPPORT DEVICE FOR RAILWAY RAILS

[76] Inventor: Armand Goossens, Beukenlaan, 35, 1560 Hoeilaart, Belgium

[21] Appl. No.: 647,766

[22] Filed: May 15, 1996

[30] Foreign Application Priority Data

Jul. 26, 1995 [BE] Belgium ..... 09500652

[51] Int. Cl.[6] ..... E01B 1/00

[52] U.S. Cl. ..... 238/382; 238/109; 238/115

[58] Field of Search ..... 238/2, 7, 107, 238/109, 110, 115, 116, 382

[56] References Cited

U.S. PATENT DOCUMENTS

| | | | |
|---|---|---|---|
| 3,907,200 | 9/1975 | Bernard | 238/109 |
| 4,728,032 | 3/1988 | Beigl et al. | 238/382 |
| 5,551,631 | 9/1996 | Cailliau | 238/382 |

FOREIGN PATENT DOCUMENTS

| | | | |
|---|---|---|---|
| 236703 | 9/1987 | European Pat. Off. | 238/109 |
| 52-11504 | 1/1977 | Japan | 238/2 |
| 3-25101 | 2/1991 | Japan | 238/382 |
| 3-125701 | 5/1991 | Japan | 238/382 |

*Primary Examiner*—Mark T. Le

*Attorney, Agent, or Firm*—Sughrue, Mion, Zinn, Macpeak & Seas, PLLC

[57] ABSTRACT

A support device has a boot 2 made of elastic material, having a bottom 3 and a peripheral sidewall 4 attached to the bottom and extending upwardly therefrom. The boot is configured to envelop a crosstie 1 from the base thereof up to a predetermined height on the side faces of the crosstie. The boot includes a first region 13 and a second region 14 for contact with the crosstie, the first region being formed at the free margin of the sidewall, and the second region being formed by a peripheral bead 11 located around the crosstie and exhibiting a predetermined dynamic stiffness. The inner surface 16 of the sidewall is slanted towards the inside of the boot with respect to the side faces of the crosstie starting from a zone located at the height of the bead so as to form a space 17 between the slanted inner surface and the side faces of the crosstie. In each comer of the sidewall, the inner surface has a recess 22 having a cross section which increases from the upper free margin of the sidewall as far as a predetermined vertical height on the inner surface.

37 Claims, 3 Drawing Sheets

SUPPORT DEVICE FOR RAILWAY RAILS

FIELD OF THE INVENTION

The present invention relates to a support device for railway rails, which device is intended for fixing a crosstie in a concrete slab

BACKGROUND OF THE INVENTION

It is already known to install a boot in a concrete slab in order partially to accommodate a railway crosstie. The known boot does however exhibit the drawback of not being very easy to handle in service, especially as regards accessibility of the crosstie which it envelops and in particular when the crosstie is to be extracted from the boot for replacement or maintenance.

The problem posed is therefore that of convenient extraction of the crosstie from the boot in which it is fixed, while nevertheless maintaining good holding of the crosstie by means of the boot in which it is enveloped, this being so as to ensure sufficient stability of the crosstie in the concrete. This stability of the crosstie is essential to ensure good reliability of the railway supported by the crosstie and thus to prevent any deformation of the railway as the result of a lack of stability of a crosstie.

SUMMARY OF THE INVENTION

The invention solves this problem by virtue of a support device for railway rails, which device is intended for fixing a crosstie in a concrete slab and comprises, for each crosstie, a boot made of elastic material, exhibiting a bottom and a peripheral sidewall attached to the bottom and extending, at least at the base, practically perpendicularly to said bottom, which boot is designed to envelop the crosstie from the base thereof up to a predetermined height on its side faces.

More particularly, the boot comprises a first and a second region for contact with the crosstie which it envelops. Said contact regions are situated a predetermined vertical distance from one another. The first contact region is formed by the free margin of the sidewall. The second contact region is formed by a peripheral bead located around the crosstie and having a predetermined dynamic stiffness. The inner surface of the sidewall is slanted towards the inside of the boot starting from a zone intended to be located at the height of the bead so as to form a space between the aforementioned inclined slanting inner surface and the side faces of the crosstie.

By virtue of this arrangement, the elasticity of the sidewall of the boot allows the crosstie to be removed from the boot and/or put back in a particularly convenient manner by moving away the free end of the sidewall of the boot and sliding the crosstie inside the perimeter of the bead. The surface for contact between the boot and the side faces of the crosstie and therefore also the friction are thus considerably reduced.

The inner surface in each corner of the sidewall is formed with a recess having a cross section which increases from the upper free margin of the sidewall as far as a predetermined vertical height on the inner surface. This arrangement according to one aspect of the invention ensures good compression of the boot in the corners and improves the peripheral tension of the boot on the crosstie which it envelops, thus contributing to the stability of the crosstie.

Furthermore, owing to its dynamic stiffness, the bead gives the device according to the invention a degree of lateral and vertical damping which thus ensures good vibrational behavior and therefore good stability of the crosstie, while maintaining the freedom to select the dynamic behavior as a function of the load applied. The stability is further enhanced by the clamping of the boot onto the crosstie at the height of the first and second regions for contact between boot and crosstie. This clamping also contributes to making the device watertight.

The stability of the crossties and of the rails is reinforced by the provision under each crosstie of an antivibration mount which improves the extent to which the vibration of the rails is damped upon the passage of vehicles running on the rails. The dynamic stiffness of the antivibration mount must be less than the stiffness of the boot.

The time constant for damping out deformations of the rails is reduced effectively, in accordance with another aspect of the invention, by selecting for the antivibration mount of each rail support, a dynamic stiffness which is such that the successive supports along each rail form an alternation of relatively rigid mounting points and relatively soft mounting points. The ratio of the dynamic stiffness of the relatively rigid mounting points to that of the relatively soft mounting points is equal to a factor of at least 5. By virtue of this arrangement, the vibrations of the rails as a vehicle runs on the rails are damped out in a very short space of time so that resonance between the rails and the traveling vehicle is avoided, which resonance detracts from the comfort of the passengers and is harmful not only to the rolling stock but also to the stability and safety of the rails. The spacing between two successive antivibration supports is selected as a function of the type of rail and of the dynamic stiffness of the antivibration mounts of said supports.

The invention is set out hereinbelow with the aid of one embodiment of the device according to the invention with reference to the appended drawings.

DESCRIPTION OF AN EXEMPLARY EMBODIMENT OF THE INVENTION

Figure 1:
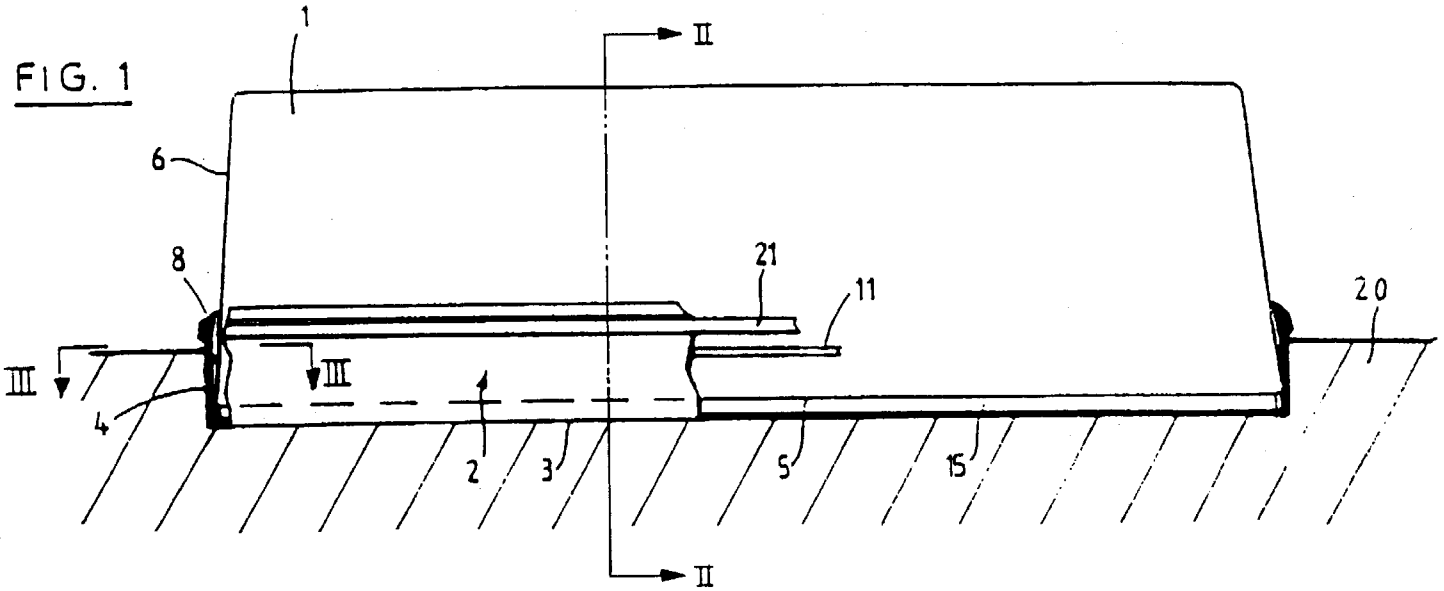
FIG. 1 is an elevation with partial cutaway of a device according to the invention.

A device for supporting rails according to the invention is illustrated in FIG. 1. The device comprises a crosstie or block 1, the lower part of which is enveloped in a boot 2. The boot has a bottom 3 and a peripheral sidewall 4 attached to the bottom and extending substantially at 90° with respect to the bottom.

The height of the sidewall 4 of the boot is designed to allow coverage in a concrete slab or bed 20 to a depth which is slightly less than said height of the sidewall 4. The boot is made of an elastic material, for example an elastomer. This material exhibits a composition giving a Shore hardness which is selected as a function of the application.

Figure 2:
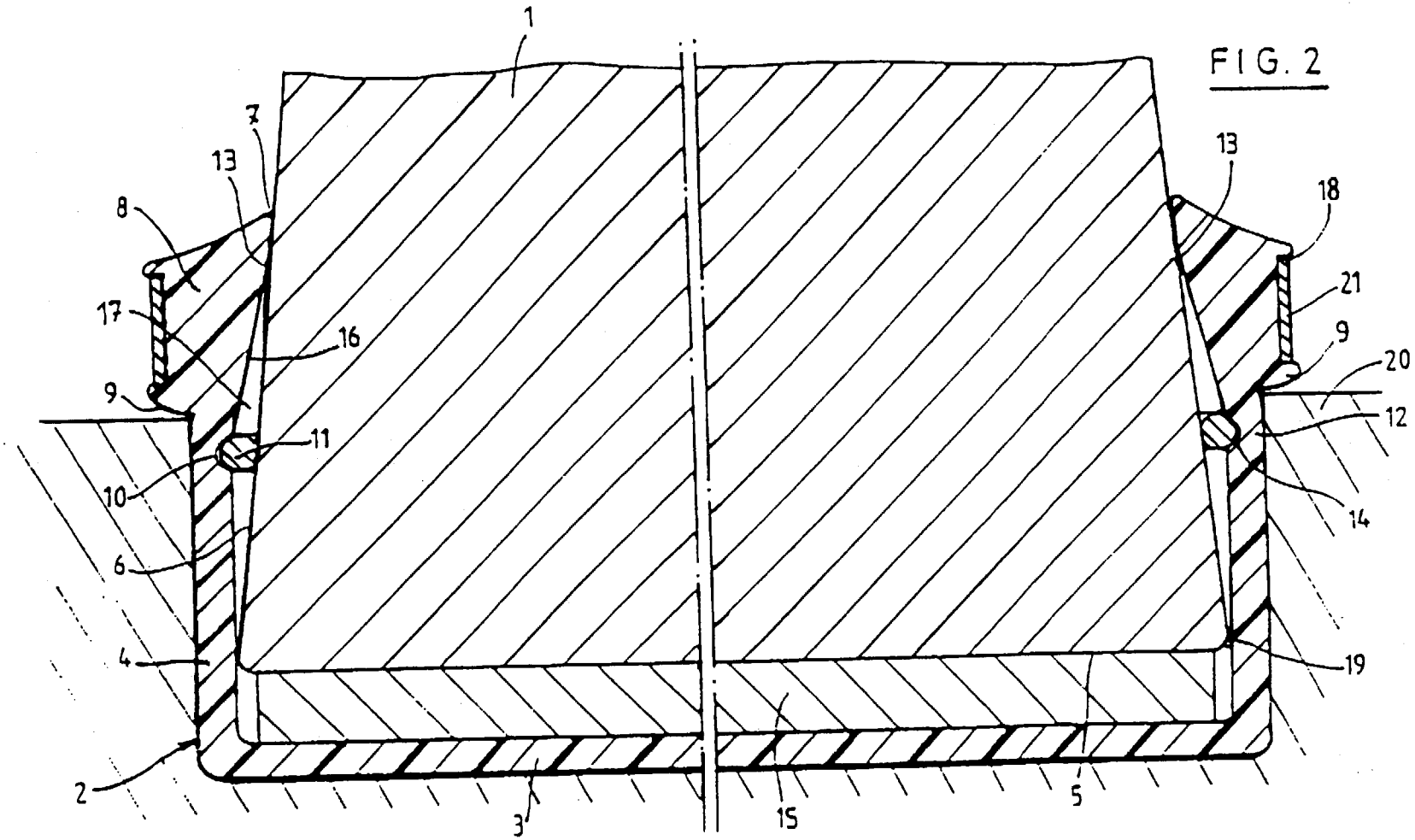
FIG. 2 is a section on II—II of FIG. 1, partially truncated, on an enlarged scale.

It is apparent from the cross section shown in FIG. 2 that, in the device according to the invention, two regions 13 and 14 are provided for contact between the boot 2 and the crosstie 1. The surface area of these respective regions is very small, which increases the ease with which the crosstie can be extracted or introduced by virtue of the reduction in friction between the crosstie and boot which results from this. In order to reduce the contact surface areas of the regions 13 and 14 to a minimum, the sidewall 4 of the boot ends in a lip 7, the latter being turned toward a side face 6 of the crosstie so that the first contact surface 13 is reduced to the contact of the lip 7 with a crosstie.

The second contact region 14 is formed by a peripheral bead 11, preferably an elastic one. This bead is located around the crosstie and held thereon, for example by its elasticity. The bead 11 exhibits a predetermined dynamic stiffness, thus giving the device the desired degree of damping. The perimeter of the bead 11 is advantageously rounded so as to reduce the contact surface area of the second contact region 14.

The two contact regions 13 and 14 are spaced apart by a predetermined distance, thus acting as a lever arm pivoting about the bead 11. By virtue of this arrangement of two contact regions 13, 14 with elasticity of the sidewall 4 of the boot, better clamping of the crosstie is obtained, with removable fixing thereof. Furthermore, owing to its dynamic stiffness, the bead gives the device according to the invention a degree of lateral and vertical damping which thus ensures good vibrational behavior and therefore good stability of the crosstie, while maintaining the freedom to select the dynamic behavior as a function of the load applied. The stability is further improved by the clamping of the boot onto the crosstie level with the first and second regions for contact between boot and crosstie. This clamping also contributes to making the device watertight.

The inner surface 16 of the portion of the sidewall 4 situated between the two contact regions 13 and 14 is slanted toward the inside of the boot so as to form an angle with the side faces 6 of the crosstie 1 and thus to leave a space 17 between the boot and the crosstie. In the aforementioned portion of the sidewall, the boot has an outwardly projecting bulge 8, forming a projection 9. The latter exhibits a convex shape allowing the free margin of the boot to be rolled outward. This outward rolling is considerably facilitated by the presence, in the wall of the boot, of a peripheral cut 10 designed to accommodate the bead 11. The depth of the cut, which for example has a rounded V shape, is for example between 40 and 60% of the thickness of the sidewall 4 of the boot. When the boot 2 is installed in the concrete 20, the projection 9 acts as a limit stop for the boot.

Figure 3:
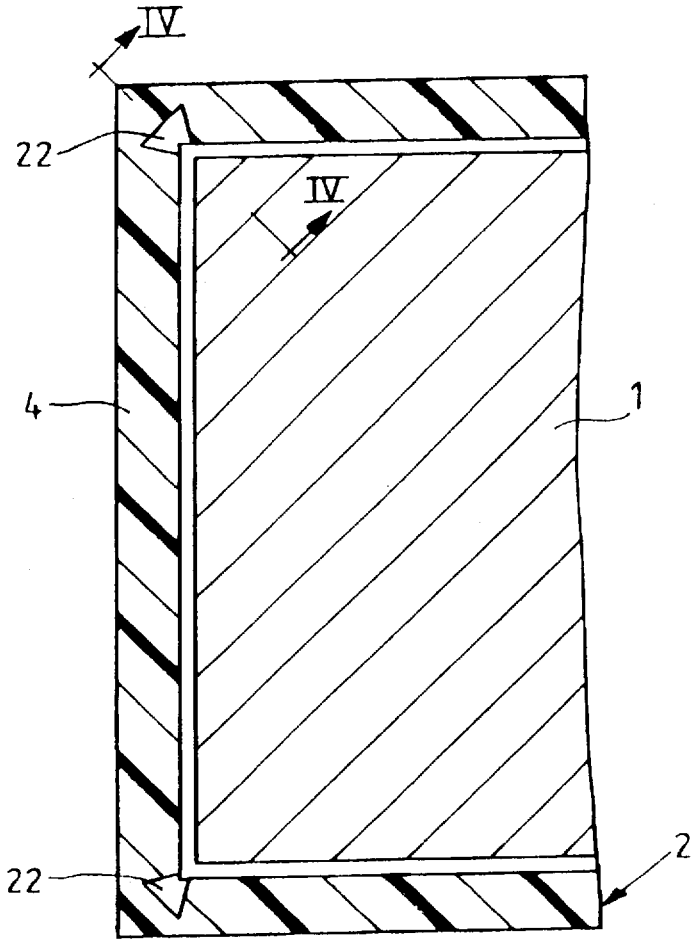
FIG. 3 is a part section on III—III of FIG. 1.
Figure 4:
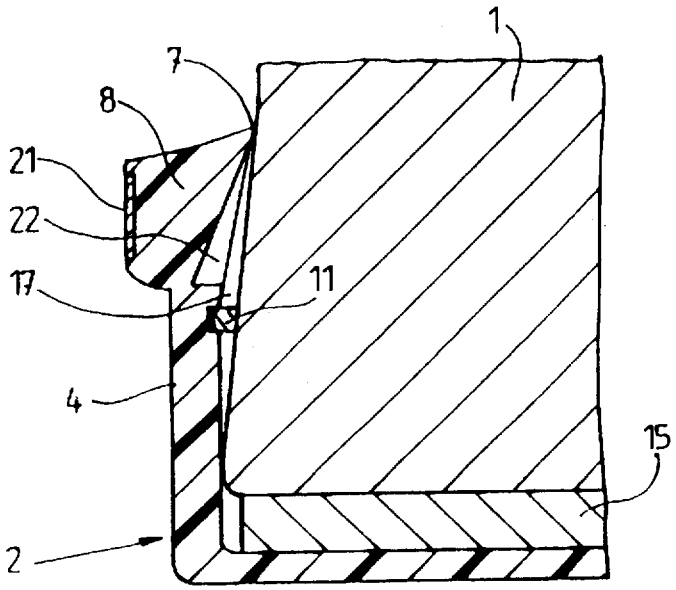
FIG. 4 is a section on IV—IV of FIG. 3.

The inner surface advantageously exhibits a recess 22 in each corner of the sidewall 4 of the boot 2, as illustrated in FIGS. 3 and 4. Each recess has a cross section which increases from the upper lip 7 of the sidewall as far as a predetermined vertical height on the inner surface. In an exemplary embodiment, said recess 22 has the overall shape of a triangular pyramid. FIG. 3 illustrates the triangular cross section of such a pyramid-shaped recess in the plane represented by the line III—III of FIG. 1.

These recesses in the corners of the sidewall of the boot have the effect of ensuring excellent compression of the boot in the corners and of thus improving the peripheral tension of the boot on the crosstie which it envelops. This contributes to the stability of the crosstie in the concrete slab.

The stability of the crosstie is also influenced by the dynamic behavior of the rails and the time constant for damping out the deformations of the rails in response to dynamic loadings as vehicles run on the rails. The damping out of vibration is considerably improved by the provision of an antivibration mount 15 under the crosstie. The dynamic stiffness of the antivibration mount must be less than the stiffness of the boot. The dynamic stiffness of the antivibration mount 15 is selected as a function of the dynamic behavior of the rails.

A dynamic study of rails commonly employed for tramways, subway trains and railroads (for example type NP4, EB50 and UIC 60 rails) has shown that the curve of deformation as a function of frequency exhibits a series of peaks which are the cause of vibration which is damped out with a time constant which greatly exceeds one millisecond and is even close to two milliseconds. As this time constant is longer than the space of time between two successive dynamic loadings applied by the wheels of the vehicle (this space of time being related to the distance between the axles of the wheels), this results in resonance between the vibration of the rail and the vibration of the vehicle itself.

Figure 5:
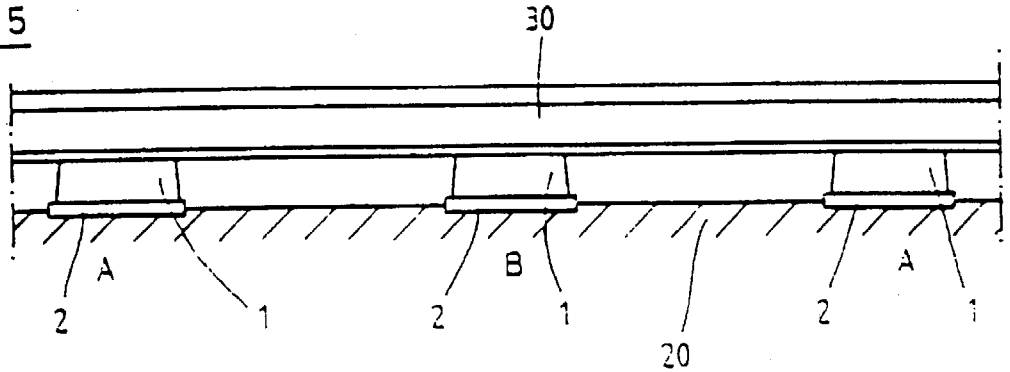
FIG. 5 is a diagrammatic drawing illustrating the alternation of the antivibration mounting points along a rail, in accordance with one aspect of the invention.

In order to reduce the time constant for the damping out of deformations of the rail so as to avoid the effects of resonance which detract from the comfort of the passengers and are harmful to the hardware (vehicles and rails), the dynamic stiffness of the antivibration mount 15 of each support device is selected so that the successive supports along each rail form antivibration mounting points having alternating dynamic stiffnesses. FIG. 5 diagrammatically represents a length of rail 30 placed on support devices according to the invention which form alternating antivibration mounting points A and B. The mounting points A and B alternate at uniform distances. The mounting points A constitute relatively rigid mounting points which will hereafter be termed rigid mounting points, and the mounting points B constitute relatively soft mounting points which will hereafter be termed soft mounting points.

At a rigid mounting point A, the antivibration mount 15 consists of a damping block having a predetermined dynamic stiffness K1. At a soft mounting point B, the antivibration mount consists of a damping block having a predetermined dynamic stiffness K2. The ratio between the dynamic stiffness of the relatively rigid mounting points A and that of the relatively soft mounting points B is advantageously equal to a factor of at least 5. The damping block forming the antivibration mount may for example consist of closed-cell polyurethane, microcellular EVA, composite material, etc. The soft mounting points do not contribute to the stiffness of the system but give it suitable damping. The rail therefore behaves like a system anchored firmly at the rigid mounting points A and having a maximum deformation at the soft mounting points B. The rail thus fixed to alternating antivibration mounting points exhibits a natural frequency which is higher than the fundamental natural frequencies of the rolling stock, which are usually below 20 Hz.

The dynamic stiffness of the mounting points is determined as a function of the type of rail and of the distance between two successive mounting points. With a separation of 750 mm for example between two successive mounting points, the rigid mounting points A have, for example, a dynamic stiffness $K1=5\times10^8$ N/m approximately and the soft mounting points B have, for example, a dynamic stiffness $K2=2\times10^7$ N/m approximately.

The deformation of a rail on mounting points having alternating stiffnesses has been calculated for UIC 60-type rail with the values given hereinabove for the dynamic stiffness K1 and K2 and a load of 112,500N corresponding to a conventional permanent way load. Calculation of the sag of the rail at a soft mounting point using the finite element method gives a sag X=1 mm. Measurements taken on site confirmed the expected results.

The sag obtained is interesting. It is less than that obtained with conventional soft mounting points (X=2.30 mm). For an unsuspended mass of 800 kg per wheel, this gives a natural frequency of the wheel/rail/support system of approximately 50 Hz, similar to that of a ballasted track and to that of a track laid on concrete with conventional soft mounting points. For the same dynamic behavior in the low frequency range, less sag of the rail is therefore obtained using the invention, and for the same sag of the rail the invention gives a lower resonant frequency of the wheel/rail/support system, which results in lower loadings on the support devices and extended durability of the hardware.

The external surface 18 of the bulge is advantageously formed with a groove designed to accommodate a peripheral banding means 21, for example a band. The latter is intended to allow immediate identification of the boot, especially as regards the nature of the antivibration mount 15 which it contains and to this end it is advantageously in the form of a colored tape. This takes on great importance in support devices for railroad rails applying the principle of alternating dynamic stiffness for the antivibration mounts. The peripheral banding means furthermore reinforces the clamping action on the crosstie and increases the watertightness of the device, while leaving the crosstie sufficient freedom that it can fulfil its damping function. To this end, a small separation 19 is also provided between the boot 2 and the base of the crosstie 1, allowing the crosstie a certain amount of play inside the boot. The peripheral banding means also makes it possible to release the crosstie if work is required on the track. By virtue of the localized nature of the contact regions 13 and 14, the process of extracting or of introducing the crosstie is made much more convenient.

I claim:

1. A support device for railway rails designed for fixing a crosstie to a concrete slab, said crosstie having a base and side faces, said support device comprising:

a boot made of elastic material, having a bottom and a peripheral sidewall attached to the bottom and extending, at the base, substantially perpendicularly upwards from said bottom, said boot being configured to envelop the crosstie from the base thereof up to a predetermined height on the side faces of the crosstie, said boot including a first region and a second region for contact with the crosstie, the first region being formed at a free margin of the sidewall, and the second region being vertically spaced from the first region and formed by a peripheral bead disposed around the crosstie and exhibiting a predetermined dynamic stiffness, an inner surface of the sidewall being slanted towards the inside of the boot with respect to the side faces of the crosstie starting from a zone located at the height of the bead and ending at an upper edge thereof so as to form a space between the slanted inner surface and the side faces of the crosstie, said inner surface of the sidewall exhibiting, in each corner thereof, a recess having a cross section which increases from an upper free margin of the sidewall to a predetermined vertical height on the inner surface.

2. The device as claimed in claim 1, wherein each recess has an overall shape of a triangular pyramid.

3. The device as claimed in claim 1, wherein the sidewall of the boot defines a peripheral cut designed to accommodate the bead.

4. The device as claimed in claim 3, wherein the depth of the cut in the sidewall of the boot is between 40% and 60% of the thickness of the sidewall.

5. The device as claimed in claim 1, wherein the bead is made of an elastic material.

6. The device as claimed in claim 1, wherein the sidewall of the boot close to its free margin defines a bulge forming a projection.

7. The device as claimed in claim 6, wherein the projection has a convex shape to include the free margin of the sidewall to be rolled outward.

8. The device as claimed in claim 6, wherein an external surface of the bulge defines a peripheral groove intended to accommodate an identifying means.

9. The device as claimed in claim 8, wherein a peripheral banding means is disposed in the peripheral groove.

10. The device as claimed in claim 9, wherein the peripheral banding means is a colored tape.

11. The device as claimed in claim 1, further comprising an antivibration mount for damping out vibrations of the environment as a vehicle is running on the rails, said antivibration mount having a stiffness lower than the stiffness of the boot.

12. A plurality of support devices as claimed in claim 11, wherein the dynamic stiffness of the antivibration mount is selected so that successive supports along the rails form an alternation of relatively rigid mounting points and relatively soft mounting points.

13. The device as claimed in claim 11, wherein the dynamic stiffness of the antivibration mount is selected as a function of the dynamic behavior of the rails.

14. The plurality of support devices as claimed in claim 12, wherein the spacing between two successive support devices is selected as a function of the type of rail and of the dynamic stiffness of the antivibration mounts.

15. A support device for railway rails designed for fixing rails to a concrete slab, said support device comprising:

a crosstie having a base and side faces, a boot made of elastic material, having a bottom and a peripheral sidewall attached to the bottom and extending, at the base, substantially perpendicularly upwards from said bottom, said boot being configured to envelop the crosstie from the base thereof up to a predetermined height on the side faces of the crosstie, said boot including a first region and a second region for contact with the crosstie, the first region being formed at a free margin of the sidewall, and the second region being vertically spaced from the first region and formed by a peripheral bead disposed around the crosstie and exhibiting a predetermined dynamic stiffness, an inner surface of the sidewall being slanted towards the inside of the boot with respect to the side faces of the crosstie starting from a zone located at the height of the bead and ending at an upper edge thereof so as to form a space (17) between the slanted inner surface and the side faces of the crosstie.

16. The device as claimed in claim 15, further comprising an antivibration mount for damping out the vibrations of the rails and of the crosstie as a vehicle is running on the rails, said antivibration mount having a stiffness lower than the stiffness of the boot.

17. A plurality of support devices as claimed in claim 16, wherein the dynamic stiffness of the antivibration mount is selected so that successive supports along the rails form an alternation of relatively rigid mounting points and relatively soft mounting points.

18. The device as claimed in claim 16, wherein the dynamic stiffness of the antivibration mount is selected as a function of the dynamic behavior of the rails.

19. The plurality of support devices as claimed in claim 17, wherein the spacing between two successive support devices is selected as a function of the type of rail and of the dynamic stiffness of the antivibration mounts.

20. A support device for railway rails designed for fixing a crosstie to a concrete slab, said crosstie comprising at least one block having a flat base and side faces, said support device comprising:

a boot made of elastic material, having a bottom and a peripheral sidewall attached to the bottom and extending, at the base, substantially perpendicularly upwardly from said bottom, said boot being configured to envelop the block from the base thereof up to a predetermined height on the side faces of the block, the bottom and sidewall being sized to fit a lower portion of the block, and a spacer bead disposed horizontally around the block to hold a substantial portion of the boot sidewall away from the side faces of the block such that said substantial portion of the boot sidewall does not frictionally engage and adhere to the side faces of the block when a vertical load is applied to the block.

21. The device as claimed in claim 20, wherein the sidewall of the boot defines a peripheral cut designed to accommodate the bead.

22. The device as claimed in claim 21, wherein the depth of the cut in the sidewall of the boot is between 40% and 60% of the thickness of the sidewall.

23. The device as claimed in claim 20, wherein the bead is made of an elastic material.

24. The device as claimed in claim 20, wherein the sidewall of the boot close to its free margin defines a bulge forming a projection.

25. The device as claimed in claim 24, wherein the projection has a convex shape to enable the free margin of the sidewall to be rolled outward.

26. The device ass claimed in claim 24, wherein an external surface of the bulge defines a peripheral groove intended to accommodate an identifying means.

27. The device as claimed in claim 26, wherein a peripheral banding means is disposed in the peripheral groove.

28. The device as claimed in claim 27, wherein the peripheral banding means is a colored tape.

29. The device as claimed in claim 20, further comprising an antivibration mount for damping out vibrations of the environment as a vehicle is running on the rails, said antivibration mount having a stiffness lower than the stiffness of the boot.

30. A plurality of support devices as claimed in claim 29, wherein the dynamic stiffness of the antivibration mount is selected so that successive supports along the rails form an alternation of relatively rigid mounting points and relatively soft mounting points.

31. The device as claimed in claim 20, wherein the dynamic stiffness of the antivibration mount is selected as a function of the dynamic behavior of the rails.

32. The plurality of support devices as claimed in claim 30, wherein the spacing between two successive support devices is selected as a function of the type of rail and of the dynamic stiffness of the antivibration mounts.

33. A support device for railway rails designed for fixing rails to a concrete slab, said support device comprising:

a crosstie comprising at least one block having a flat base and side faces, a boot made of elastic material, having a bottom and a peripheral sidewall attached to the bottom and extending, at the base, substantially perpendicularly upwardly from said bottom, said boot being configured to envelop the block from the base thereof up to a predetermined height on the side faces of the block, the bottom and sidewall being sized to fit a lower portion of the block, and a spacer bead disposed horizontally around the block to hold a substantial portion of the boot sidewall away from the side faces of the block such that said substantial portion of the boot sidewall does not frictionally engage and adhere to the side faces of the block when a vertical load is applied to the block.

34. The device as claimed in claim 33, further comprising an antivibration mount for damping out the vibrations of the environment as a vehicle is running on the rails, said antivibration mount having a stiffness lower than the stiffness of the boot.

35. A plurality of support devices as claimed in claim 34, wherein the dynamic stiffness of the antivibration mount is selected so that successive supports along the rails form an alternation of relatively rigid mounting points and relatively soft mounting points.

36. The device as claimed in claim 34, wherein the dynamic stiffness of the antivibration mount wherein the dynamic stiffness of the antivibration mount is selected as a function of the function of the dynamic behavior of surrounding structures.

37. A plurality of support devices as claimed in claim 35, wherein the spacing between two successive support devices is selected as a function of the type of rail and of the dynamic stiffness of the antivibration mounts.

* * * * *